United States Patent [19]

Kaga et al.

[11] Patent Number: 4,798,522

[45] Date of Patent: Jan. 17, 1989

[54] JOINT STRUCTURE FOR FLUID SUPPLY PUMP AND FLUID SUPPLY PIPE

[75] Inventors: Hideki Kaga, Kariya; Hisanori Kobayashi, Chita, both of Japan

[73] Assignee: Nippondenso Co., Ltd., Kariya, Japan

[21] Appl. No.: 938,145

[22] Filed: Dec. 4, 1986

[30] Foreign Application Priority Data

Dec. 4, 1985 [JP] Japan ..... 60-273094

[51] Int. Cl.[4] ..... F04B 39/12

[52] U.S. Cl. ..... 417/363; 285/158; 137/565; 123/468

[58] Field of Search ..... 417/363, 366, 360; 285/158; 137/565; 123/468

[56] References Cited

U.S. PATENT DOCUMENTS

| | | | |
|---|---|---|---|
| 1,461,385 | 7/1923 | Falor | 285/158 X |
| 2,258,941 | 10/1941 | Wayman | 285/158 |
| 2,377,891 | 6/1945 | Laue | 285/158 X |
| 2,425,826 | 8/1947 | Radtke | 285/158 X |
| 3,430,990 | 3/1969 | Nelson | 285/158 X |
| 4,086,032 | 4/1978 | Nishioka et al. | 417/363 |
| 4,307,693 | 12/1981 | Glockler et al. | 123/470 |
| 4,327,690 | 7/1982 | Sauer et al. | 123/470 X |
| 4,334,835 | 6/1982 | Dyhs et al. | 417/363 |
| 4,531,894 | 7/1985 | Kawai et al. | 417/363 X |

FOREIGN PATENT DOCUMENTS

| | | |
|---|---|---|
| 58-15756 | 1/1983 | Japan . |
| 59-150995 | 8/1984 | Japan . |

*Primary Examiner*—Carlton R. Croyle
*Assistant Examiner*—Theodore Olds
*Attorney, Agent, or Firm*—Cushman, Darby & Cushman

[57] ABSTRACT

A joint structure has a fuel supply pump disposed within a fuel tank in a vertical posture, and a fuel outlet pipe projecting from the upper end surface of the fuel supply pump. A cylindrical retaining member is fitted around the fuel outlet pipe and an O ring is also fitted around the fuel outlet pipe in contact with the upper end surface of the cylindrical retaining member. The inner surface of the O ring is in close contact with the outer surface of the outlet pipe. A cylindrical joint member penetrates the upper wall of the fuel tank and an upper opening of the joint member is connected to one end of a fuel supply pipe leading to an engine. The fuel outlet pipe is pressed into a lower opening of the joint member. At this time, the outer peripheral surface of the O ring retained by the cylindrical retaining member in contact therewith, comes in close contact with an inner surface of the joint member.

10 Claims, 3 Drawing Sheets

JOINT STRUCTURE FOR FLUID SUPPLY PUMP AND FLUID SUPPLY PIPE

BACKGROUND OF THE INVENTION

1. Field of the Invention

The present invention relates to a joint structure for joining a fluid supply pump with a fluid supply pipe, and more particularly relates to a joint structure suitably applicable for use with a fuel supply pump in a vehicle.

2. Description of the Prior Art

In many cases, the fuel supply pump in a vehicle is provided within the fuel tank. One example of a fuel supply pump for a vehicle is shown in FIG. 2.

As shown in FIG. 2, a fuel supply pump 3 is disposed within a fuel tank 1 is vertically is vertically The pump housing of the pump 3 is composed of a sealed cylindrical body. The pump 3 is supported by a supporting member 5 provided within the fuel tank 1 through a well known rubber bushing 4. The lower end of the pump 3 is joined with a fuel inlet pipe 15 having a filter 151. From the upper end surface of the pump 3 centrally projects a fuel outlet pipe 6.

The upper wall of the fuel tank 1, to which a tip end of the fuel outlet pipe 6 is opposed is upwardly expanded. A cylindrical joint member 12 is provided so as to penetrate the expanded portion of the upper wall of the fuel tank 1. The lower end of the cylindrical joint member 12 is opposed to the tip end of the outlet pipe 6 at a position close thereto. The upper end of the joint member 12, which is exposed to the outside of the fuel tank 1 is joined with one end of a fuel supply pipe 8 leading to an engine (not shown).

The outlet pipe 6 is joined with the joint member 12 by means of a rubber pipe 13 and around each of both ends of the rubber pipe 13 is fitted a metallic clamp 14.

The outlet pressure of the fuel supply pump normally reaches a maximum pressure which is over 2 $Kg/cm^2$. For obtaining a sufficiently high sealing property, the close contact area between the rubber pipe 13 and each of the outlet pipe 6 and the joint member 12 must be made large by increasing the length of each of the outlet pipe 6 and the joint member 12.

Due to recent trends in automotive design in which the height H of the fuel tank tends to be strictly limited for enlarging the space of the passenger compartment, it is difficult to obtain a sufficiently long space for the outlet pipe 6 and the joint member 12.

Under the above circumstances, it is proposed that the contact pressure of the rubber pipe 13 with the outlet pipe 6 or the joint member 12 is increased by decreasing the inner diameter of the rubber pipe. But, this method is troublesome in assembling.

SUMMARY OF THE INVENTION

It is one object of the present invention to provide a joint structure for a fluid supply pump and a fluid supply pipe which is capable of joining them to each other with sufficiently good sealing and without increasing the length of an outlet pipe of the fluid supply pump and a joint member provided in the fluid supply pipe.

It is another object of the present invention to provide a joint structure for a fluid supply pump and a fluid supply pipe, which is simple to assemble and use.

The joint structure according to the present invention comprises an outlet pipe projecting from a pump housing of a fluid supply pump, a cylindrical retaining member fitted on the outer periphery of the outlet pipe, the length of the cylindrical retaining member being shorter than that of the outlet pipe so as to expose a tip end of the outlet pipe on which the cylindrical retaining member is fitted, an O ring closely fitted on the outer periphery of a tip end of the outlet pipe in contact with a tip end surface of the retaining member, a cylindrical joint member to which one end of a fluid supply pipe is jointed and with which the fluid supply pipe is communicated. The inner diameter of the joint member is larger than the outer diameter of the outlet pipe and the outer periphery of the O ring closely comes in contact with the inner periphery of the joint member while the outlet pipe is pressed into the joint member.

According to the joint structure having the above described structure, good sealing property of the joint portion is maintained by means of the O ring which is in close contact with the outer periphery of the outlet pipe and the inner periphery of the joint member. This joint structure does not require such a measure as to increase the length of the outlet pipe and that of the joint member. Therefore, by applying the above described joint structure to a fuel supply pump provided within a fuel tank, the whole height of the fuel tank can be decreased.

Furthermore, since the O ring is made to be retained in contact with the end surface of the retaining member, there does not occur such disadvantage that the O ring falls out due to the pressure generated when the outlet pipe is pressed into the joint member. And the joining of the outlet pipe and the joint member can be easily performed at only one touch.

DETAILED DESCRIPTION OF THE EMBODIMENTS

Figure 1:
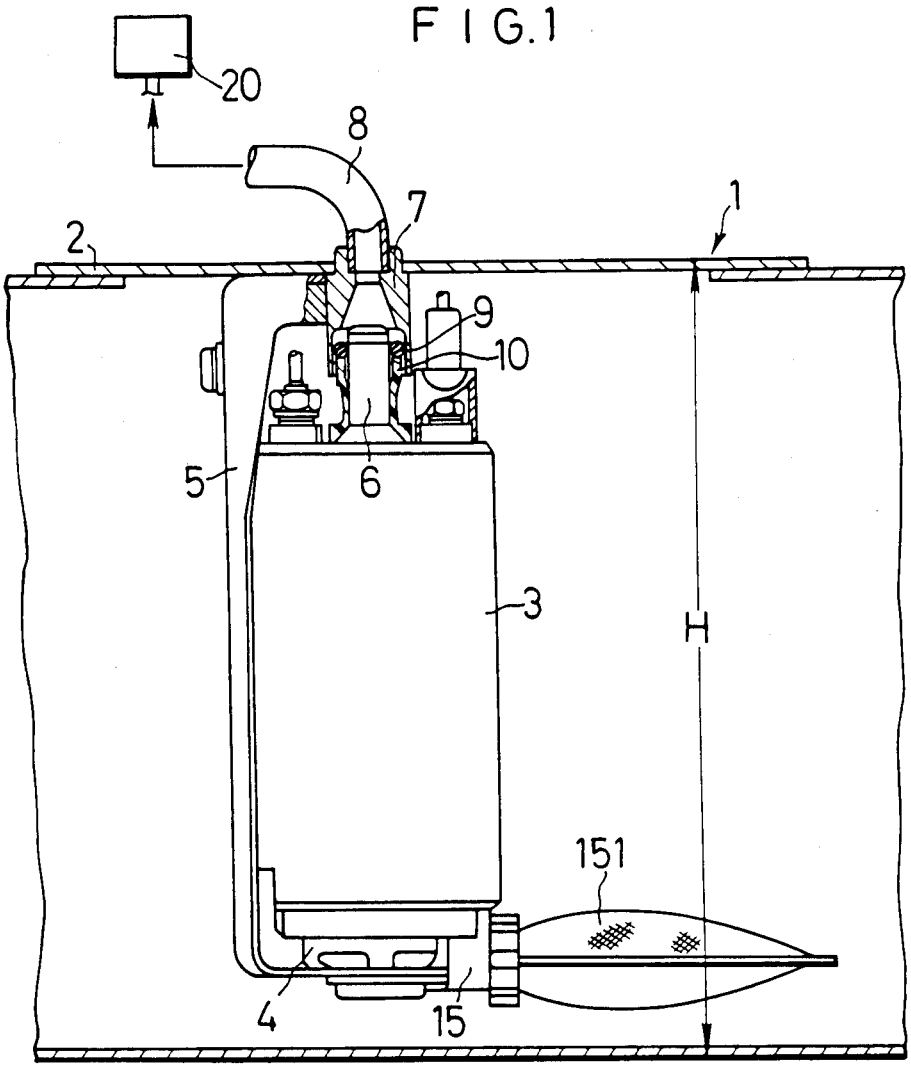
FIG. 1 is a partially sectioned side view of a fuel supply pump having a joint structure according to the present invention provided within a fuel tank.
Figure 2:
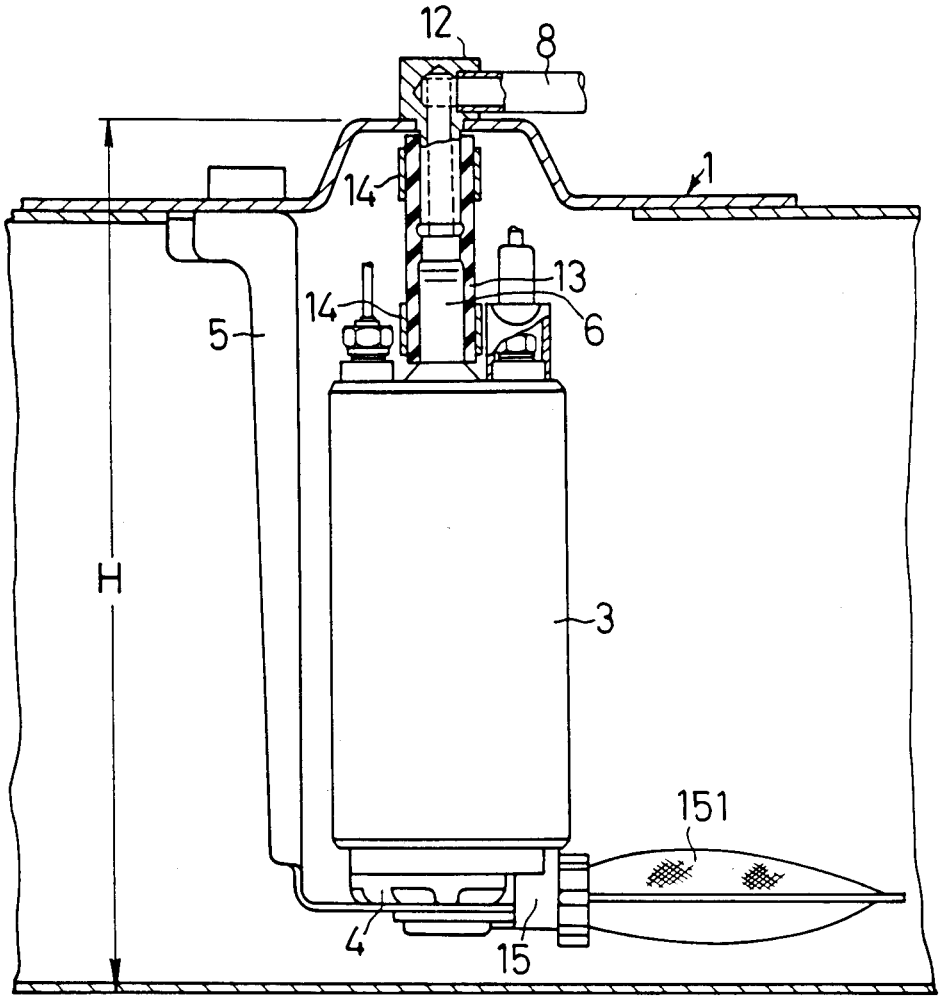
FIG. 2 PRIOR ART
FIG. 2 is a partially sectioned side view of a conventional fuel supply pump provided within a fuel tank.

In FIG. 1, a fuel tank is provided with an opening in its upper wall and the opening is fixedly covered with a cover plate 2. A cylindrical joint member 7 projects from the center of the cover plate 2. An inner space of the joint member 7 is gradually expanded toward a lower opening of a large diameter. The upper opening of the joint member 7 is positioned above the cover plate 2 and joined to one end of a fuel supply pipe 8 leading to an engine 20. An upper end of a nearly L-shaped supporting member 5 is welded to the under surface of the cover plate 2.

A fuel pump 3 has a housing composed of a sealed cylindrical body. The lower end surface of the fuel pump 3 is supported by a supporting member 5 through a rubber bush 4 whereby the fuel pump 3 is disposed within the fuel tank 1 in a vertical posture. A fuel intake pipe 15 extends sideward from the lower end surface of the fuel pump 3 and a spindle-shaped filter 151 is secured to the intake pipe 15.

A fuel outlet pipe 6 projects from the center of the upper end surface of the fuel pump 3. The outlet pipe 6 is made of synthetic resin and is mass-produced as an integral body with the upper end surface of the pump 3

A cylindrical retaining member 10 having a shape corresponding to that of the outer periphery of the outlet pipe 6 is fitted on the outlet pipe 6. The retaining member 10 is formed of synthetic resin having elasticity. And the length of the retaining member 10 is made shorter than that of the outlet pipe 6 and the tip end of the outlet pipe 6 is exposed to the outside of the retaining member 10.

And an O ring 9 made of rubber is closely fitted on the outer periphery of the tip end of the outlet pipe 6 and comes in contact with the upper surface of the retaining member 10.

The outlet pipe 6 provided with the retaining member 10 and the O ring 9 is pressed into the lower opening of the joint member 7 as shown in FIG. 1 and in this state the O ring 9 is in close contact with the inner surface of the lower opening of the joint member 7.

This results in good sealing property of the joint portion being obtained by virtue of the O ring 9 which is in close contact with the outer surface of the outlet pipe 6 and the inner surface of the joint member 7.

When the outlet pipe 6 is pressed into the joint member 7, the O ring 9 is retained by the upper end surface of the retaining member 10 in contact therewith. This results in such disadvantage as falling of the O ring due to the pressure generated when the outlet pipe 6 is pressed into the joint member 7 being overcome.

The fuel supply pump vibrates in its axial direction during operation. According to the present embodiment, this vibration can be efficiently absorbed by means of the deformable elastic retaining member and accordingly, this vibration is prevented from being transmitted to the joint member and the cover plate.

Figure 3:
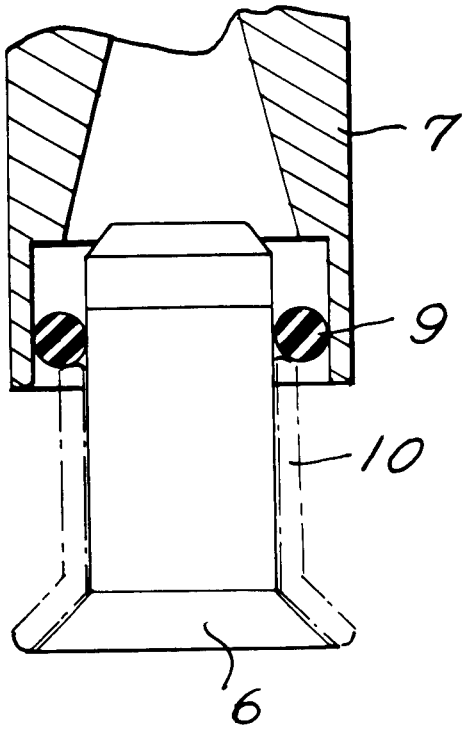
FIG. 3 is a partially sectioned side view of a main portion of a modified embodiment of a fuel supply pump having a joint structure which is constructed according to the present invention.

A coil spring composed of a cylindrically wound wire spring can be also used as the retaining member, as is illustrated in FIG. 3 in phantom lines.

According to the joint structure of the present invention, the length of the outlet pipe and the joint member need not be increased. This results in the whole height of the fuel tank can be decreased as compared with the conventional joint structure.

Furthermore, the joining of the outlet pipe and the joint member can be easily performed by pressing the outlet pipe provided with the O ring and the retaining member into the joint member at only one touch.

What is claimed is:

1. A joint structure for a fluid supply pump and a fluid supply pipe comprising:

an outlet pipe projecting from a pump housing of said fluid supply pump;

a cylindrical retaining member fitted on an outer periphery of said outlet pipe, the length of said cylindrical retaining member being less than the length of said outlet pipe, thereby exposing a tip end portion of said outlet pipe;

a O-ring closely fitted on an outer periphery of said tip end portion of said outlet pipe so that said cylindrical retaining member contacts said O-ring at its upper end, and contacts an upper end surface of said pump housing at its lower end; and a cylindrical joint member to which one end of a fluid supply pipe is connected and communicating with said supply pipe; said outlet pipe being pressed into said joint member; said joint member having an inner diameter that is larger than the outer diameter of said outlet pipe and the outer diameter of said O-ring so that an outer periphery of said O-ring closely contacts an inner periphery of said joint member while said O-ring is retained by and in contact with said cylindrical retaining member when said outlet pipe is pressed into said joint member.

2. A joint structure according to claim 1, wherein said fluid supply pump is a pump for supplying engine fuel and said fluid supply pipe is a fuel supply pipe leading to an engine.

3. A joint structure according to claim 2, wherein said pump for supplying fuel has a pump housing made of a sealed cylindrical body; said pump housing being elastically supported within said fuel tank in a vertical posture, said outlet pipe projects from an upper end surface of said pump housing, and said outlet pipe is pressed into said joint member fixed to an upper wall of said fuel tank.

4. A joint structure according to claim 1, wherein said retaining member is composed of a vibration-absorbable elastic body.

5. A joint structure according to claim 4, wherein said elastic body is made of synthetic resin.

6. A joint structure according to claim 4, wherein said elastic body is composed of a cylindrically wound wire spring.

7. A joint structure for use with a fluid supply pump having an outlet pipe extending therefrom and a fluid supply pipe, comprising:

a hollow cylindrical retaining member having an inner periphery of an inner diameter that is greater than the outer length of the outlet pipe, and a length that is less than the length of the outlet pipe, one end of said hollow cylindrical retaining member being capable of contacting the fluid supply pump, whereby the retaining member may be fitted onto the outlet pipe so as to leave a tip end portion of the outlet pipe exposed;

a resilient O-ring having an inner diameter approximately the same as the outer diameter of the outlet pipe so as to be tightly fittable onto the tip end portion of the outlet pipe, the other end of said cylindrical retaining member being capable of contacting said O-ring; and a cylindrical joint member having an interior bore communicable with a fluid supply pipe, said bore having an inner diameter that is slightly larger than an outer diameter of said O-ring, said joint member being fittable over said O-ring which is fittable over the outlet pipe, and said O-ring being retainable by and in contact with said cylindrical retaining member, whereby a joint is provided which has good sealing characteristics and is relatively compact.

8. A joint structure according to claim 7, wherein said retaining member is composed of a vibration absorbable elastic body.

9. A joint structure according to claim 8, wherein said elastic body is made of synthetic resin.

10. A joint structure according to claim 8, wherein said elastic body is composed of a cylindrically wound wire spring.

* * * * *